US010550503B2

(12) United States Patent
Maruyama et al.

(10) Patent No.: US 10,550,503 B2
(45) Date of Patent: Feb. 4, 2020

(54) SEWING MACHINE

(71) Applicant: JUKI CORPORATION, Tokyo (JP)

(72) Inventors: Takeshi Maruyama, Tokyo (JP); Takashi Imano, Tokyo (JP); Toshiki Sugiyama, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 223 days.

(21) Appl. No.: 15/428,507

(22) Filed: Feb. 9, 2017

(65) Prior Publication Data

US 2017/0226676 A1 Aug. 10, 2017

(30) Foreign Application Priority Data

Feb. 10, 2016 (JP) ..... 2016-023203

(51) Int. Cl.
*D05B 19/14* (2006.01)
*D05B 69/00* (2006.01)

(52) U.S. Cl.
CPC ..... *D05B 19/14* (2013.01); *D05B 69/00* (2013.01); *D05D 2205/02* (2013.01)

(58) Field of Classification Search
CPC ..... D04B 19/08; D04B 19/10; D04B 19/12; D04B 19/14; D04B 69/00
USPC ..... 112/470.04, 470.01
See application file for complete search history.

(56) References Cited

U.S. PATENT DOCUMENTS 4,602,885 A * 7/1986 Bischoff ..... B43L 15/00 15/437
6,883,446 B2 * 4/2005 Koerner ..... D05B 19/14 112/272
8,528,491 B2 * 9/2013 Bentley ..... D05B 11/00 112/470.01
9,115,451 B2 * 8/2015 Konzak ..... D05B 21/00
9,315,932 B2 * 4/2016 Abe ..... D05B 19/12
2003/0131773 A1 * 7/2003 Schweizer ..... D05B 19/16 112/102.5
2005/0016428 A1 1/2005 Koerner
2009/0205549 A1 8/2009 Hirose et al.
(Continued)

FOREIGN PATENT DOCUMENTS

JP A-2002-090152 3/2002
JP 2002-292175 A 10/2002
(Continued)

OTHER PUBLICATIONS

JP Office Action dated Nov. 26, 2019 from corresponding Japanese patent application No. 2016-023203 (with attached English-language translation).

*Primary Examiner* — Danny Worrell
(74) *Attorney, Agent, or Firm* — Drinker Biddle & Reath LLP

(57) ABSTRACT

A sewing machine includes a sewing machine motor, a control device and a wearable sensor. The sewing machine motor is a vertical movement driving source of a needle bar. The control device controls the sewing machine motor such that a sewing pitch is set to be a predetermined value. The wearable sensor is attached on a body of an operator of the sewing machine to detect a moving amount of an attached portion of the wearable sensor. The control device controls the sewing machine motor based on the moving amount of the attached portion detected by the wearable sensor such that the sewing pitch is set to be the predetermined value.

3 Claims, 3 Drawing Sheets

(56) References Cited

U.S. PATENT DOCUMENTS

| | | | | |
|---|---|---|---|---|
| 2016/0289876 | A1* | 10/2016 | Hosaka | D05B 19/006 |
| 2017/0226676 | A1* | 8/2017 | Maruyama | D05B 69/00 |

FOREIGN PATENT DOCUMENTS

| | | | |
|---|---|---|---|
| JP | 2006-517449 | A | 7/2006 |
| JP | A-2002-089626 | | 8/2009 |
| JP | A-2015-146058 | | 8/2015 |

* cited by examiner

SEWING MACHINE

CROSS-REFERENCE TO RELATED APPLICATIONS

This application is based upon and claims the benefit of priority from Japanese Patent Application No. 2016-023203, filed on Feb. 10, 2016; the entire contents of which are incorporated herein by reference.

BACKGROUND OF INVENTION

Field of the Invention

The present invention relates to a sewing machine which performs sewing at a constant sewing pitch.

Related Art

In the related art, there is known a sewing machine in which an optical element fixedly provided in a frame of a sewing machine captures a workpiece on a throat plate obtains a feeding amount of the workpiece from captured data, and a sewing machine motor is controlled to locate a needle at a constant feeding amount so that a sewing pitch is kept to a predetermined value (for example, JP-A-2002-292175 and JP-A-2006-517449).

SUMMARY

However, the sewing machine according to the related art detects the feeding amount of the workpiece by the capturing optical element, which easily affects the surface state such as colors, shapes, gloss, and irregularity of the workpiece. Therefore, there is a risk that the feeding amount of the workpiece cannot be detected reliably, and the sewing pitch cannot be constant.

An object of the invention is to make a sewing pitch constant more accurately.

(1) According to one aspect of the invention, a sewing machine includes a sewing machine motor, a control device and a wearable sensor. The sewing machine motor is a vertical movement driving source of a needle bar. The control device controls the sewing machine motor such that a sewing pitch is set to be a predetermined value. The wearable sensor is attached on a body of an operator of the sewing machine to detect a moving amount of an attached portion of the wearable sensor. The control device controls the sewing machine motor based on the moving amount of the attached portion detected by the wearable sensor such that the sewing pitch is set to be the predetermined value.

(2) In the sewing machine according to (1), the wearable sensor is attached on a hand or a wrist of the operator of the sewing machine.

(3) In the sewing machine according to (1), the wearable sensor includes an acceleration sensor.

(4) In the sewing machine according to (3), the wearable sensor includes an angular velocity sensor.

(5) In the sewing machine according to any one of (1) to (4), the wearable sensor includes a first sensor which detects an acceleration in a direction along a palm plane of a hand of the operator of the sewing machine, and a second sensor which detects another motion performed by the hand of the operator of the sewing machine. The control device controls the sewing machine motor based on detection of the first sensor such that the sewing pitch is set to be the predetermined value. The control device performs a control stored in advance in the control device, based on detection of the second sensor.

The invention includes the wearable sensor which is attached on a body of an operator of the sewing machine so as to detect the movement amount of the attached portion. The control device can control the sewing machine motor based on the movement amount of the attached portion obtained based on the detection of the wearable sensor such that the sewing pitch is set to be the predetermined value. For this reason, the movement amount of the attached portion interlinked with the workpiece can be detected more reliably while the surface state such as colors, shapes, gloss, and irregularity of the workpiece is not affected. Thus, the sewing pitch can be kept more accurately to the target value so as to improve a sewing quality.

DETAILED DESCRIPTION

Figure 1:
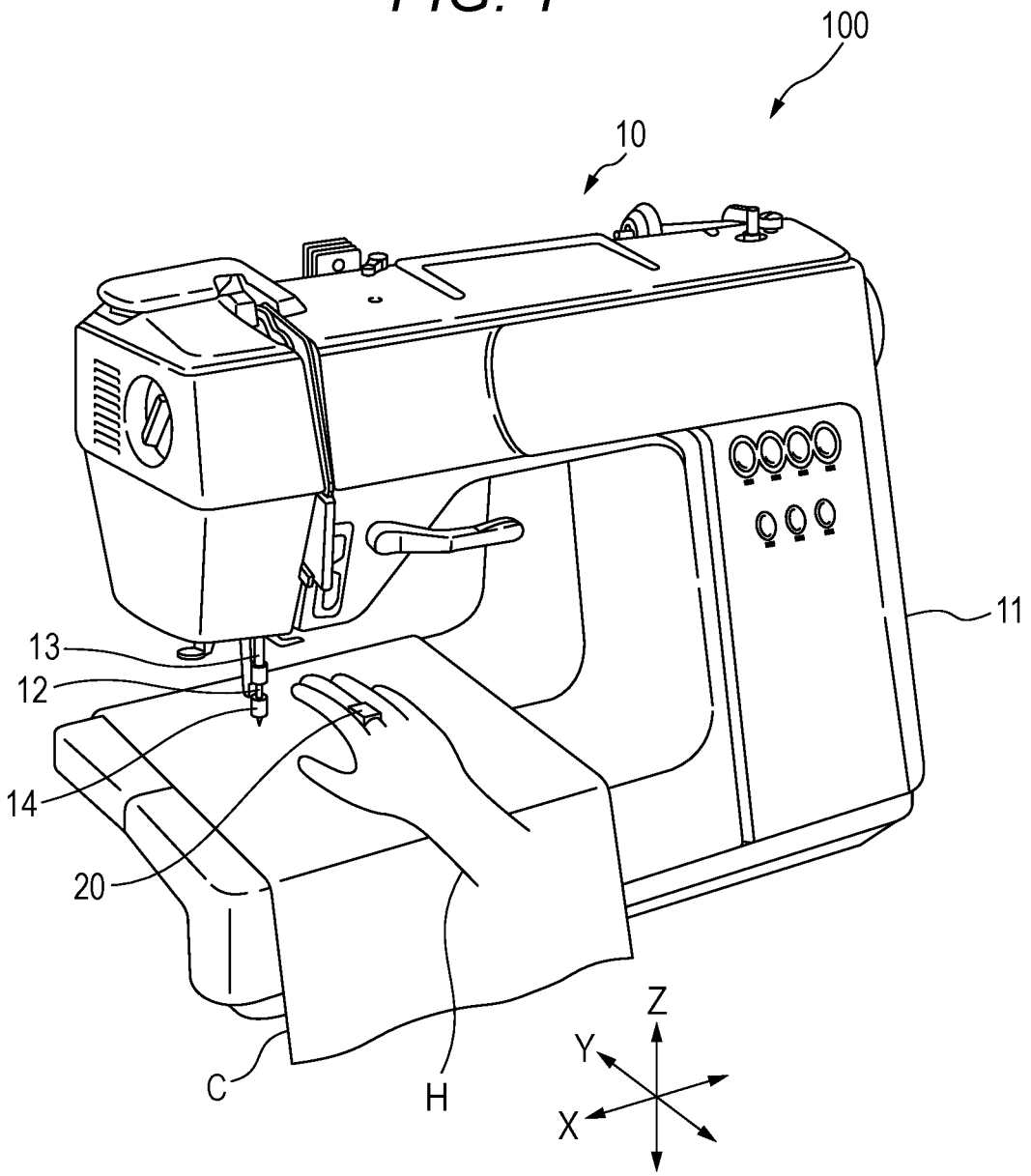
FIG. 1 is a perspective view illustrating a sewing machine according to an embodiment of the invention.

Hereinafter, a sewing machine according to the invention will be described with reference to the drawings. FIG. 1 is a perspective view illustrating a sewing machine 100.

The sewing machine 100 according to this embodiment is a sewing machine which can perform a free-motion sewing in which an operator of the sewing machine randomly feeds cloth C, which is as a workpiece on a throat plate, by hand. The sewing machine 100 mainly includes a sensor module 20 as a wearable sensor which is attached on a finger of a hand of the operator of the sewing machine 100 and a sewing machine body 10 which forms seams with respect to the cloth C.

[Sewing Machine Body]

The sewing machine body 10 includes a needle bar vertical movement mechanism which vertically moves a needle bar 13 holding a sewing needle 12 from an lower end, a hook mechanism which catches an upper thread passing through the sewing needle to be entangled with a lower thread, a thread take-up lever mechanism which pulls up the upper thread to form a node, a thread tensioner which applies a predetermined tension to the upper thread, a sewing machine frame 11 which stores or holds them, and a control device 90 which controls an operation of each part.

Since the needle bar vertical movement mechanism, the hook mechanism, the thread take-up lever mechanism, the thread tensioner, and the sewing machine frame 11 have the same configuration as the well-known configuration of the sewing machine, a detailed description is not given.

The sewing machine frame 11 includes a bed portion positioned in the lower portion of the sewing machine body, a vertical drum portion which is erected from one end of the bed portion, and an arm portion which extends from the vertical drum portion in the same direction as the bed portion.

In the following description, a right and left direction, which is horizontal and is along the longitudinal direction of the bed portion, is set as an X-axis direction, a front and rear direction, which is a horizontal direction and is orthogonal to the X-axis direction, is set as a Y-axis direction, and a vertical direction, which is orthogonal to the X-axis direction and the Y-axis direction, is set as a Z-axis direction.

The sewing machine body 10 includes an inner presser 14 which presses the cloth C so that the sewing needle 12 smoothly comes off the cloth C when raising up. The inner presser 14 is a frame body through which the sewing needle 12 can be loosely inserted. The inner presser 14 receives power from a sewing machine motor 30 (see FIG. 2), which is a driving source for moving the needle bar 13 vertically, through a well-known transmission mechanism, and performs a vertical movement in the same period as that of the needle bar 13 or at an amplitude smaller than that of the needle bar 13. The phase of the inner presser 14 is deviated from that of the needle bar 13, and the inner presser 14 is lowered while the sewing needle 12 is raised. The inner presser 14 is set to have a slight gap with respect to the throat plate in a lower dead center position so as not to interrupt the feeding of the cloth C.

Figure 2:
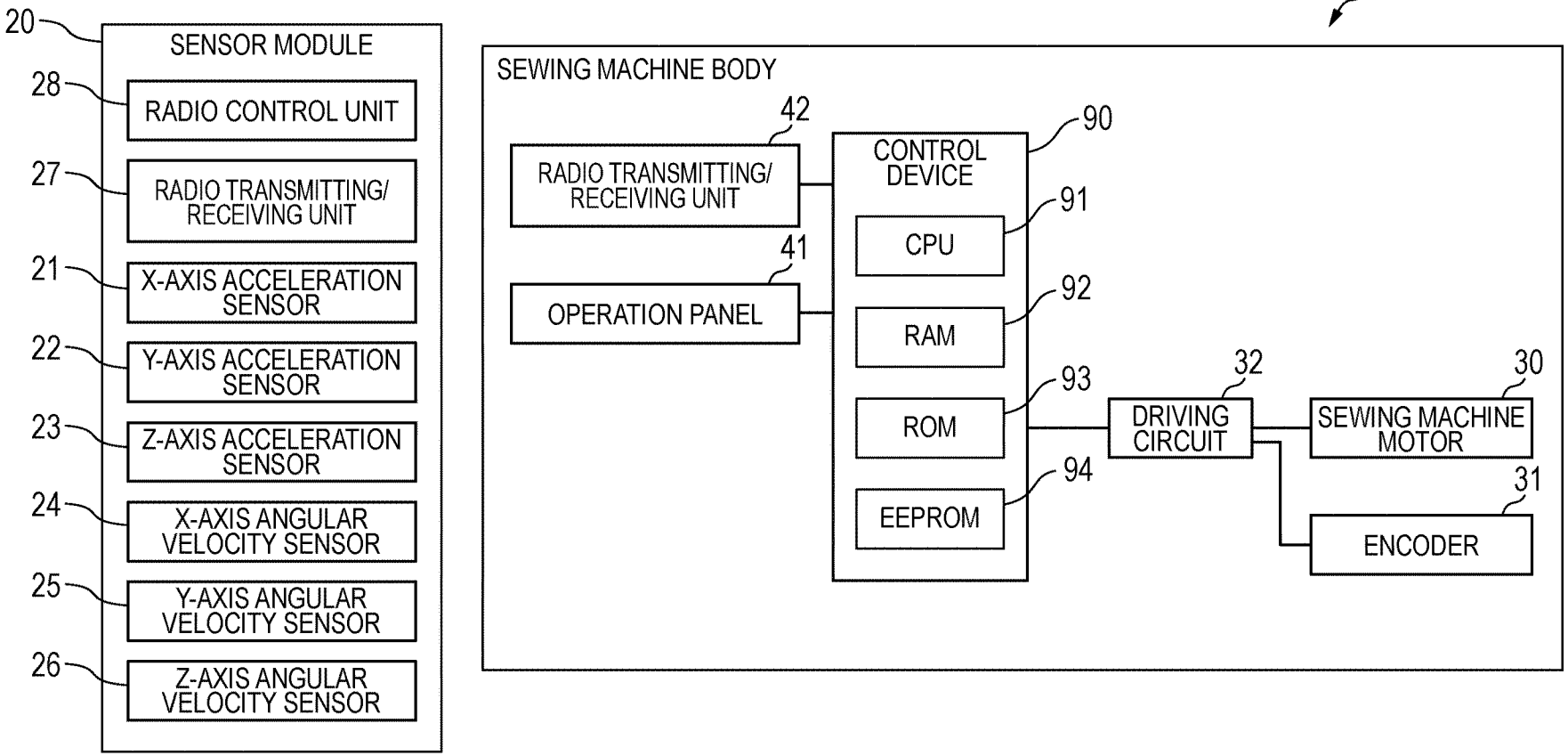
FIG. 2 is a block diagram illustrating a control system of the sewing machine.

FIG. 2 illustrates a control system of the sewing machine 100.

The sewing machine body 10 includes the control device 90 which controls the operation of each configuration. The sewing machine motor 30 and an encoder 31 are connected with the control device 90 through a driving circuit 32, the sewing machine motor 30 being a driving source of a sewing operation, and the encoder 31 detecting the output-axis angle (upper-axis angle) of the sewing machine motor 30.

An operation panel 41, which is an operating unit used by the operator of the sewing machine when an input operation is performed on the sewing machine, and a radio transmitting/receiving unit 42, which receives detection data of various sensors transmitted by radio from the sensor module 20, are connected with the control device 90 through respective interfaces (not illustrated).

For example, a sewing pitch, which is a length of a seam per one needle, is set by using the operation panel 41.

The radio transmitting/receiving unit 42 is a communication device which places data on a carrier wave and transmits/receives the data. However, the radio transmitting/receiving unit 42 may use a near field communication technology such as RFID (radio frequency identifier) or NFC (Near field radio communication).

The radio transmitting/receiving unit 42 transmits a command that requests the transmission of the detection data to the sensor module 20, and receives the detection data from the sensor module 20.

The control device 90 mainly includes a CPU 91 which controls the sewing machine motor 30, a RAM 92 which is an operating area of the CPU 91, and a ROM 93 which stores a program processed by the CPU 91, and an EEPROM 94 as a storage unit which is configured to store the data used in an arithmetic processing and to revise the corresponding data.

[Sensor Module]

As illustrated in FIG. 1, the sensor module 20 is attached on a finger of a hand H of the operator of the sewing machine, and is mounted with a plurality of sensors for detecting the movement of the hand at the time of sewing.

That is, as illustrated in FIG. 2, the sensor module 20 includes a X-axis acceleration sensor 21 which detects an acceleration in the X-axis direction, a Y-axis acceleration sensor 22 which detects an acceleration in the Y-axis direction, a Z-axis acceleration sensor 23 which detects an acceleration in the Z-axis direction, a X-axis angular velocity sensor 24 which detects an angular velocity of a rotation about the X-axis, a Y-axis angular velocity sensor 25 which detects an angular velocity of a rotation about the Y-axis, a Z-axis angular velocity sensor 26 which detects an angular velocity of a rotation about the Z-axis, a radio transmitting/receiving unit 27 which transmits the detection data of the sensors 21 to 26, and a radio control unit 28 which controls the sensors 21 to 26 to perform a detection and controls to transmit the detection data to the sewing machine body 10 according to the command that requests the transmission of the detection data received from the sewing machine body 10 through the radio transmitting/receiving unit 27.

Similarly to the radio transmitting/receiving unit 42 of the sewing machine body 10, the radio transmitting/receiving unit 27 is a communication device which places data on a carrier wave and transmits/receives the data. However, the radio transmitting/receiving unit 27 may use a near field communication technology such as RFID (radio frequency identifier) or NFC (Near field radio communication).

The sensor module 20 is integrated with an annular portion which is configured to be attached on the finger of the hand H (for example, right hand) of the operator of the sewing machine, and a rectangular housing portion which stores the sensors 21 to 26, the radio transmitting/receiving unit 27, and the radio control unit 28.

In the sensor module 20, a direction of inserting the finger into the annular portion is set in advance. The housing portion is set to be on the back side of the hand with respect to the annular portion when the sensor module 20 is attached on the finger.

At the time of sewing, as illustrated in FIG. 1, the operator of the sewing machine places the right hand wearing the sensor module 20 on one side (right side in the drawing) in the X-axis direction with respect to a needle locating position on the upper surface of the bed portion. A feeding operation is performed while the cloth C is pressed in a posture in which the tip of the finger is directed to the Y-axis direction (a front side in the drawing). Assuming that the hand of the operator of the sewing machine has the above-described posture, the sensors 21 to 26 of the sensor module 20 detects the acceleration in each axis direction and the angular velocity about each axis.

Therefore, the X-axis acceleration sensor 21 and the Y-axis acceleration sensor 22 function as first sensors which detect the acceleration in a direction along a palm plane of the operator of the sewing machine. Additionally, the other sensors 23 to 26 function as second sensors which detect the other motions performed by the hand.

[Sewing Pitch Adjustment Control]

The description will be given about a sewing pitch adjustment control performed by the control device 90 of the sewing machine body 10.

In the sewing pitch adjustment control, the sewing machine motor 30 is controlled such that the cloth C randomly fed on the bed portion by the hand of the operator of the sewing machine is sewn with the set sewing pitch set from the operation panel 41 maintained.

The feeding amount of the cloth C is calculated by the control device 90 based on the acceleration of each axis direction which is detected by the X-axis acceleration sensor 21 and the Y-axis acceleration sensor 22 as the first sensors mounted in the sensor module 20.

Figure 3:
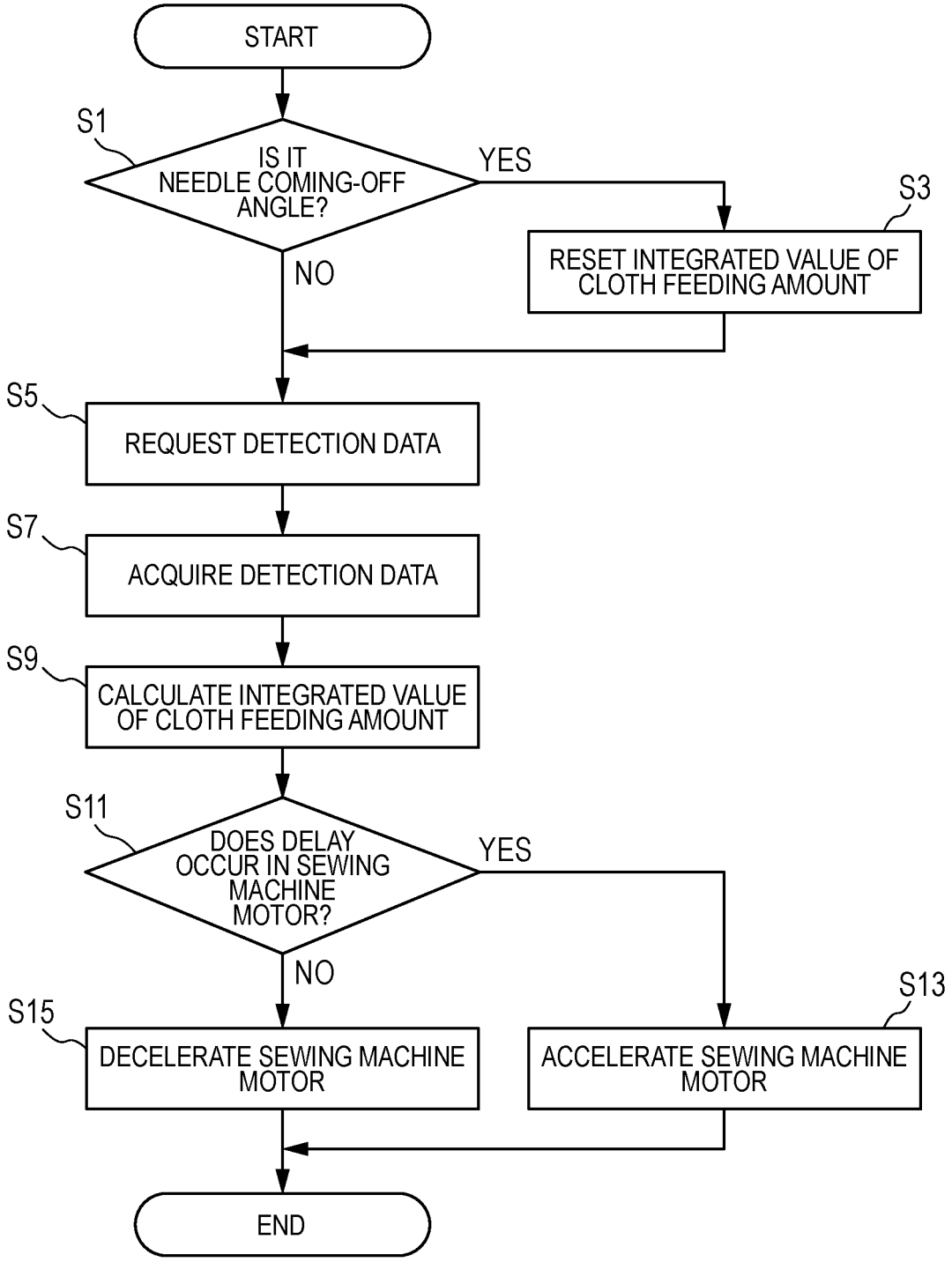
FIG. 3 is a flowchart of a sewing pitch adjustment control.

FIG. 3 illustrates a flowchart of the sewing pitch adjustment control performed by the control device 90. According to this, a process performed by the control device 90 will be described in order. The process of the sewing pitch adjustment control illustrated in the flowchart is repeatedly performed in a sampling period sufficiently shorter than the vertical movement period of the needle bar 13 while the sewing machine motor 30 is driven.

First, the CPU 91 of the control device 90 integrates respective minute cloth feeding amounts in the sampling periods so as to obtain a cloth feeding amount per one needle from the motion of the sensor module 20. The start and end of the integration are set by an upper-axis angle (needle coming-off angle) when the sewing needle 12 passing through the lower dead center position rises to come off from the cloth C.

Therefore, in the sewing pitch adjustment control, the CPU 91 determines whether the present upper-axis angle detected by the encoder 31 is the needle coming-off angle (Step S1).

At that time, in a case where the present upper-axis angle is the needle coming-off angle, an integrated value of the cloth feeding amount is reset, and the procedure proceeds to a next process (Step S3). In a case where the present upper-axis angle is not the needle coming-off angle, the procedure proceeds to a next process without any change.

In the next the process, the CPU 91 transmits a command to request the detection data, which is from the sensor module 20, to the sensor module 20 through the radio transmitting/receiving unit 42 to calculate the minute cloth feeding amount in the sampling period (Step S5).

When receiving the command to request the detection data, the radio control unit 28 of the sensor module 20 transmits the present detection data detected by the sensors 21 to 26 to the sewing machine body 10 through the radio transmitting/receiving unit 27.

Next, when acquiring the present detection data detected by the sensors 21 to 26 from the sensor module 20 (Step S7), the CPU 91 calculates the integrated value of the cloth feeding amount in the present needle location (Step S9).

In order to calculate the integrated value of the cloth feeding amount, first, the minute cloth feeding amount in the sampling period is calculated.

The minute cloth feeding amount is calculated from a feeding rate of the present cloth in the X-axis direction and the Y-axis direction.

First, a feeding rate $v_x$ of the present cloth in the X-axis direction is obtained by a following formula when a rate in the sampling period of the previous time is set to $v_{0x}$, an acceleration in the X-axis direction detected this time is set to $a_x$, and a sampling period is set to t.

$$v_x=v_{0x}+a_x\cdot t \tag{1}$$

Similarly, a feeding rate vy of the present cloth in the Y-axis direction is obtained by a following formula when a rate in the sampling period of the previous time is set to $v_{0y}$, an acceleration in the Y-axis direction detected this time is set to $a_y$, and a sampling period is set to t.

$$v_y=v_{0y}+a_y\cdot t \tag{2}$$

Therefore, a cloth feeding rate v in a feeding direction of the present cloth satisfies $$v=(v_x^2+v_y^2)^{1/2} \tag{3}$$

Further, a minute cloth feeding amount mm of the sampling period at this time satisfies $$mm=v\cdot t=t\cdot(v_x^2+v_y^2)^{1/2} \tag{4}$$

A minute cloth feeding amount m calculated in this manner is added to the integrated value of the cloth feeding amount until the previous time.

Next, the CPU 91 determines from the present upper-axis angle and the present integrated value of the cloth feeding amount whether a delay occurs in the driving rate of the sewing machine motor 30 (Step S11).

In the cloth C, the cloth feeding is performed in a range of the upper-axis angle until the sewing needle 12 is thrust again after the sewing needle 12 comes off. Thus, the range of the upper-axis angle is divided to minute angle ranges, and the integrated value of the ideal cloth feeding amount of each minute angle range can be set in advance according to the set sewing pitch.

The CPU 91 determines whether the integrated value of the present upper-axis angle and the present cloth feeding amount is smaller than the integrated value of the corresponding ideal cloth feeding amount.

A case where the integrated value of the present cloth feeding amount is smaller than the integrated value of the ideal cloth feeding amount indicates that a rate of the sewing machine motor 30 is delayed, and thus the rate is accelerated at a specific angular acceleration (Step S13). A case where the integrated value of the present cloth feeding amount is equal to or more than the integrated value of the ideal cloth feeding amount indicates that the rate of the sewing machine motor 30 exceeds the integrated value, and thus the rate is decelerated at a specific angular acceleration (Step S15).

Then, the sewing pitch adjustment control of one sampling period is ended.

When the above-described sewing pitch adjustment control is repeatedly performed in the sampling period, the rotation rate of the sewing machine motor 30 is optimized so that the sewing pitch of each needle location can be set to the predetermined value.

[Another Control According to Operation of Sensor Module (1)]

As described above, the sensor module 20 includes four sensors 23 to 26 in addition to the X-axis acceleration sensor 21 used in the sewing pitch adjustment control and the Y-axis acceleration sensor 22. Thus, another control stored in advance in the control device 90 can be performed by using detection data of the four sensors in addition to the sewing pitch adjustment control. Otherwise, the detection data of any one of the six sensors 21 to 26 is combined, and another control stored in advance in the control device 90 can be performed.

The detailed example will be described as follows.

For example, a predetermined operation is performed by allowing the right hand H of the operator of the sewing machine in which the sensor module 20 is attached on the finger to have a posture different from that of a cloth feeding operation, and thus it is possible to control the driving and the stop of the sewing machine motor.

Specifically, when the right hand H starts to move forward (front side of FIG. 1) in the Y-axis direction in a state where the palm thereof stands perpendicularly, the CPU 91 of the control device 90 performs a control to start the driving of the sewing machine motor 30 accordingly.

In the case, similarly to the above-described sewing pitch adjustment control, the CPU 91 periodically transmits a command to request the detection data, which is from the sensor module 20, to the sensor module 20, and acquires the detection data of each of the sensors 21 to 26 from the sensor module 20.

Then, in a case where the turning of the Y-axis rotation (for example, right rotation) of the sensor module 20 is detected from the detection data of the Y-axis angular velocity sensor 25, and the movement of the sensor module 20 to the front side in the Y-axis direction is detected from the detection data of the Y-axis acceleration sensor 22, the CPU 91 performs a motion control to start the driving of the sewing machine motor 30.

When the hand starts to move forward in the Y-axis direction in a state where the palm thereof stands perpendicularly, and the forward movement rate accelerates, the CPU 91 of the control device 90 performs a control to raise the driving rate of the sewing machine motor 30 accordingly.

In this case, in a case where the turning of the sensor module 20 in the Y-axis rotation (for example, left rotation) is not detected from the detection data of the Y-axis angular velocity sensor 25, and it is detected from the detection data of the Y-axis acceleration sensor 22 that the movement of the sensor module 20 to the front side in the Y-axis direction accelerates in a state where the palm of the hand stands perpendicularly, the CPU 91 performs the motion control to raise the driving rate of the sewing machine motor 30.

When the cloth C is moved with the palm of the hand directed horizontally, then the palm of the hand stands perpendicularly, and the right hand H maintains in a stationary state without a movement in the Y-axis direction, accordingly, the CPU 91 of the control device 90 performs a control to stop the driving of the sewing machine motor 30.

In this case, in a case where the turning of the sensor module 20 in the Y-axis rotation (for example, right rotation) is detected from the detection data of the Y-axis angular velocity sensor 25, and it is detected from the detection data of the Y-axis acceleration sensor 22 that the sensor module 20 is stationary in a state where the palm of the hand stands perpendicularly, the CPU 91 performs a motion control to stop the sewing machine motor 30.

In this manner, by a predetermined operation of the hand, the operator of the sewing machine can perform an input operation regarding the driving of the sewing machine motor 30 as well as the operator detects the feeding amount of the cloth C.

[Another Control by Operation of Sensor Module (2)]

In a case where an actuator is newly mounted in the sewing machine body 10, the sensor module 20 can be used in the motion control of the actuator.

For example, the inner presser 14 has a small vertical stroke compared to the needle bar 13, and thus even in a case where the inner presser 14 is in an upper dead center position, the height thereof is low, and it is not easy to perform an operation such as an exchange of the cloth C. For this reason, a solenoid may be mounted which forcibly pulls up the inner presser 14 above the upper dead center position.

In such a case, when the right hand H of the operator of the sewing machine in which the sensor module 20 is attached on the finger performs a predetermined motion different from the cloth feeding operation, the rise and the drop of the inner presser 14 can be controlled by the solenoid.

Specifically, when the right hand H moves upward in the Z-axis direction in a horizontal state where the palm of the hand of the right hand H is directed upward, accordingly, the CPU 91 of the control device 90 performs a motion control to drive the solenoid such that the inner presser 14 is raised.

In this case, in a case where the turning of the Y-axis rotation (for example, right rotation) of the sensor module 20 is detected from the detection data of the Y-axis angular velocity sensor 25, and it is detected from the detection data of the Z-axis angular velocity sensor 26 that the sensor module 20 moves downward in the Z-axis direction in a horizontal state where the palm of the hand of the right hand H is directed upward (since the palm of the hand is directed upward, when the hand moves upward in such a state, the Z-axis acceleration sensor 23 detects the downward movement), the CPU 91 performs a motion control to drive the solenoid to rise.

When the right hand H moves downward in the Z-axis direction in a horizontal state where the palm of the hand of the right hand H is directed downward, accordingly, the CPU 91 of the control device 90 performs a motion control to drive the solenoid such that the inner presser 14 lowers.

In this case, in a case where the turning of the Y-axis rotation (for example, left rotation) of the sensor module 20 is detected from the detection data of the Y-axis angular velocity sensor 25, and it is detected from the detection data of the Z-axis angular velocity sensor 26 that the sensor module 20 moves downward in the Z-axis direction in a horizontal state where the palm of the hand of the right hand H is directed downward, the CPU 91 performs a motion control to drive the solenoid to lower.

In this manner, by a predetermined motion of the hand, the operator of the sewing machine can perform an input operation regarding a vertical movement of the inner presser 14.

A thread cutting motor, which performs a thread cutting motion, as a new actuator can be mounted in the sewing machine body 10.

In this case, when the right hand H of the operator of the sewing machine in which the sensor module 20 is attached on the finger performs a predetermined motion different from the cloth feeding operation such that the hand moves to right and left sides in the X-axis direction in a state where the palm thereof stands perpendicularly, accordingly, the CPU 91 of the control device 90 performs a motion control to drive the thread cutting motor so as to execute thread cutting.

In this case, in a case where the turning of the Y-axis rotation (for example, left rotation) of the sensor module 20 is detected from the detection data of the Y-axis angular velocity sensor 25, and it is detected from the detection data of the Z-axis acceleration sensor 23 that the sensor module 20 moves downward in the Z-axis direction in a state where the palm of the hand is directed to the right side (since the palm of the hand is directed to the right side, when the hand moves to the right side in such a state, the Z-axis acceleration sensor 23 detects the downward movement), the CPU 91 performs a motion control to drive the thread cutting motor.

In this manner, the operator of the sewing machine can perform an input operation to execute the thread cutting by a predetermined motion of the hand.

[Technical Effects According to Embodiment of the Invention]

The above-configured sewing machine 100 includes the sensor module 20 which is attached on the hand H which is a body of the operator of the sewing machine and detects the movement amount of the hand H as the attached portion. The control device 90 controls the sewing machine motor 30 based on the movement amount of the hand H obtained based on the detection of the X-axis acceleration sensor 21 and the Y-axis acceleration sensor 22 of the sensor module 20 such that the sewing pitch is set to be the predetermined value.

For this reason, the movement amount of the hand H interlinked with the cloth C can be detected more reliably while the surface state such as colors, shapes, gloss, and irregularity of the cloth C is not affected. Thus, the sewing pitch can be kept more accurately to the target value so as to improve a sewing quality.

Particularly, the sensor module 20 is attached on the hand H of the operator of the sewing machine. Thus it is possible to detect the feeding motion of the cloth C more reliably, and to keep the sewing pitch to the target value more accurately.

Further, the sensor module 20 includes the acceleration sensors 21 to 23 of the X axis, the Y axis, and the Z axis. Thus, it is possible to detect a spatial movement motion in a state where the sensors 21 to 23 float in the air without being supported in the sewing machine frame and the like, and to detect the feeding amount of the cloth C without interrupting the operation or the motion of the operator of the sewing machine.

The sensor module 20 includes the acceleration sensors 21 and 22 of the X axis and the Y axis which are first sensors for acquiring the feeding amount of the cloth C, and the sensors 23 to 26 which are second sensors for detecting another motion of the hand H except that. The control device 90 controls the sewing machine motor based on the detection of the acceleration sensors 21 and 22 of the X axis and the Y axis such that the sewing pitch is set to be the predetermined value, and thus another control such as a vertical movement of the inner presser 14 and an execution of the thread cutting motion is performed based on the detection of any one of the sensors 23 to 26. The sensor module 20 can be used to perform various kinds of input operations without being limited to the detection of the feeding amount of the cloth C.

What is claimed is:

1. A sewing machine comprising:

a sewing machine motor that is a vertical movement driving source of a needle bar;

a control device that controls the sewing machine motor such that a sewing pitch is set to be a predetermined value; and a wearable sensor that includes a first sensor which detects an acceleration in a direction along a surface of a cloth or along a surface perpendicular to the cloth, and a second sensor which detects a physical amount which is different from the acceleration detected by the first sensor, wherein the control device controls the sewing machine motor based on detection of the first sensor such that the sewing pitch is set to be the predetermined value, and the control device performs a control stored in advance in the control device, based on detection of the second sensor.

2. The sewing machine according to claim 1, wherein the wearable sensor includes an acceleration sensor.

3. The sewing machine according to claim 2, wherein the wearable sensor includes an angular velocity sensor.

* * * * *